United States Patent [19]

Karr

[11] Patent Number: 4,732,391

[45] Date of Patent: Mar. 22, 1988

[54] GOLF BALL STORAGE AND DISPENSING APPARATUS

[75] Inventor: Robert J. Karr, Wyandotte, Mich.

[73] Assignee: Tee-Wizz Co., Inc., Wyandotte, Mich.

[21] Appl. No.: 779,166

[22] Filed: Sep. 23, 1985

[51] Int. Cl.[4] ..... A63B 57/00

[52] U.S. Cl. ..... 273/201

[58] Field of Search ..... 273/201, 202, 182 R, 273/182 A, 33, 35 A, 176 A, 184 R, 181, 26 D

[56] References Cited

U.S. PATENT DOCUMENTS

| | | | |
|---|---|---|---|
| 1,940,321 | 12/1933 | Pagett | 273/201 |
| 2,171,299 | 8/1939 | Beckett | 273/201 |
| 2,530,698 | 11/1950 | Hogeberg | 273/201 |
| 2,675,237 | 4/1954 | Willcox | 273/201 |
| 2,955,823 | 10/1960 | Chanko | 273/26 D |
| 2,955,824 | 10/1960 | Chanko | 273/26 D |
| 3,599,983 | 8/1971 | Melton | 273/201 |
| 4,146,232 | 3/1979 | Stone | 273/201 |
| 4,177,996 | 12/1979 | Chang | 273/201 |
| 4,441,717 | 4/1984 | Willcox | 273/201 |
| 4,541,632 | 9/1975 | Tillery | 273/201 |
| 4,548,407 | 10/1985 | Sato | 273/201 |

FOREIGN PATENT DOCUMENTS

| | | | |
|---|---|---|---|
| 10871 | of 1927 | Australia | 273/201 |
| 574237 | 3/1933 | United Kingdom | 273/201 |
| 1110564 | 4/1968 | United Kingdom | 273/201 |
| 2129310 | 5/1984 | United Kingdom | 273/201 |

*Primary Examiner*—Richard C. Pinkham
*Assistant Examiner*—T. Brown
*Attorney, Agent, or Firm*—Ladas & Parry

[57] ABSTRACT

A golf ball storage and dispensing apparatus includes a dispenser unit and a storage unit connected to the dispenser unit and adapted to store a plurality of golf balls. An actuator mechanism is mounted in the dispenser unit, the golf balls being fed from the storage unit to the actuator mechanism. The actuator mechanism comprises a motor including a power source, an arm mechanism pivotable about a support shaft between a substantially vertical position and a substantially horizontal position, and a gear train assembly having a series of interacting toothed gear wheels, the gear train assembly being intermediate the motor and the arm mechanism. The actuator mechanism also comprises a reciprocating rod between the gear train assembly and the arm mechanism, the rod being axially moved by the gear train assembly and having its other end connected to the support shaft of the arm mechanism. A switch is also provided for activating the actuator mechanism. When actuated, the arm mechanism is moved from its vertical to its horizontal position, the golf ball rolls down the arm mechanism to be deposited adjacent the dispenser unit, and the arm mechanism is returned to its vertical position. A rotor is mounted to the last shaft of the gear wheel in the gear train assembly. The rotor has a body portion mounted on the rotor shaft, a rotor arm and a pin extending from the body portion substantially parallel to the rotor shaft. The rod has a series of four open-ended slots therein the rotor shaft being located in the first and third slot and the pin being located in the second and fourth slot, as the rotor turns through 360° and back again. At the completion of each 360° turn, the rotor arm strikes a switch to reverse the current in the motor and switch off the motor respectively.

32 Claims, 13 Drawing Figures

GOLF BALL STORAGE AND DISPENSING APPARATUS

BACKGROUND OF THE INVENTION

This invention relates to golf ball storage and dispensing apparatus. The apparatus of the invention is designed to assist golfers, both indoors and outside, whereby golf balls may be successively dispensed and located at a particular point so that the golfer will not have to break his stance after hitting a first ball in order to properly place a subsequent ball.

A number of types of golf ball storage and dispensing apparatus are already known. An example of such prior art is U.S. Pat. No. 4,360,204. Such apparatus permits the golfer to store a large number of golf balls to be dispensed by the apparatus one at a time when actuated by the golfer.

The apparatus normally includes an arm, movable between a vertical and a horizontal position by a drive mechanism. A golf ball rolls down the arm when moved to the horizontal position, and is deposited at the desired location. Some prior art drive mechanisms are designed such that the arm is connected directly to a gear train driven by a motor. This produces a number of difficulties in control of the finer movements of the arm. Other prior art drive mechanisms may operate the arm indirectly through a shaft, and use rubber belts or the like in the gear train. Clearly, such belts are subject to slippage and increased wear, so that the drive mechanism requires more frequent servicing and maintenance.

An object of the present invention is to provide such a golf ball storage and dispensing apparatus having a number of improved features for increasing the efficiency and operation thereof. It is also an object of the present invention to provide apparatus having an improved drive mechanism and switching mechanism for controlling the direction of movement of the arm.

SUMMARY OF THE INVENTION

According to one aspect of the invention there is provided a golf ball storage and dispensing apparatus comprising: a dispenser unit; a golf ball storage unit connected to the dispenser unit, the storage unit being adapted for storage of a plurality of golf balls and for delivering successively to the dispenser unit a single golf ball; and an actuator mechanism mounted in the dispenser unit so that the balls delivered to the dispenser unit are directed to the actuator mechanism, the actuator mechanism comprising: a motor including a power source therefor; an arm mechanism pivotable about a support shaft between a substantially vertical position and a substantially horizontal position; and a gear train assembly having a series of interacting toothed gear wheels, the gear train assembly being intermediate the motor and the arm mechanism, whereby the arm mechanism is moved from its vertical position to its substantially horizontal position, a golf ball rolls down the arm mechanism to be deposited adjacent the dispenser unit, and the arm mechanism is returned to its vertical position, the actuator mechanism retaining the arm mechanism in its horizontal position for a sufficiently long period to enable the golf ball to roll down the entire length of the arm mechanism and be deposited adjacent the dispenser unit.

There is preferably provided a reciprocating rod between the gear train assembly and the arm mechanism, the rod being axially moved at its one end by the gear train assembly and having its other end connectable to the support shaft of the arm mechanism. Conveniently, switch means for activating the actuator mechanism is provided.

The dispenser unit may comprise a base member and a cover member over the base member, the base and cover member defining a chamber. Preferably, the cover has an aperture therein, the actuator mechanism is located in the chamber beneath the aperture, a portion of the arm mechanism projects through the aperture, and a track is provided on the upper surface of the cover for directing golf balls from the storage unit to the aperture.

Conveniently, the storage unit comprises a central core, a spiral hopper surrounding the core, and an outer transparent cylindrical envelope about the spiral hopper. The dispenser unit includes a battery compartment having an access door.

The arm mechanism may comprise a golf ball feed control mounted on the support shaft, and an elongate arm connected to the feed control by means of a bolt member. Preferably, the elongate arm comprises a pair of parallel shafts, the distance between which is slightly less than the diameter of a golf ball, and a rounded end, the diameter of which is greater than that of a golf ball, the arrangement being that a golf ball will roll between the pair of parallel shafts and through the space defined by the rounded end.

Preferably, the gear train assembly comprises a first gear wheel about the motor shaft, four intermediate gear wheels, and an end gear wheel in contact with the rod and a rotor is mounted to the shaft of the last gear wheel in the series of the gear train assembly. In a preferred embodiment, the rotor has a body portion mounted on the rotor shaft, a rotor arm normal to the axis of the rotor shaft, and a pin extending therefrom substantially parallel to the rotor shaft. The rod preferably has a series of four open-ended slots therein, with the rotor shaft being located in the first slot and the pin being located in the second slot when the arm mechanism is in the vertical position, whereby upon actuation of the switch means, the rotor shaft with rotor is rotated, the pin rotated about the rotor shaft in the second slot causing the rod to substantially reciprocate in an axial direction until the rotor has completed one half turn, the rotor shaft being received in the third slot after a half turn, and upon completion of a full turn, the rotor arm strikes a direction switch reversing the current in the motor to cause the rotor to return in the opposite direction thereby moving the rod to its original position. The rotor arm also activates the direction switch at the completion of its return rotation to switch off the motor.

DESCRIPTION OF THE PREFERRED EMBODIMENT

Figure 1:
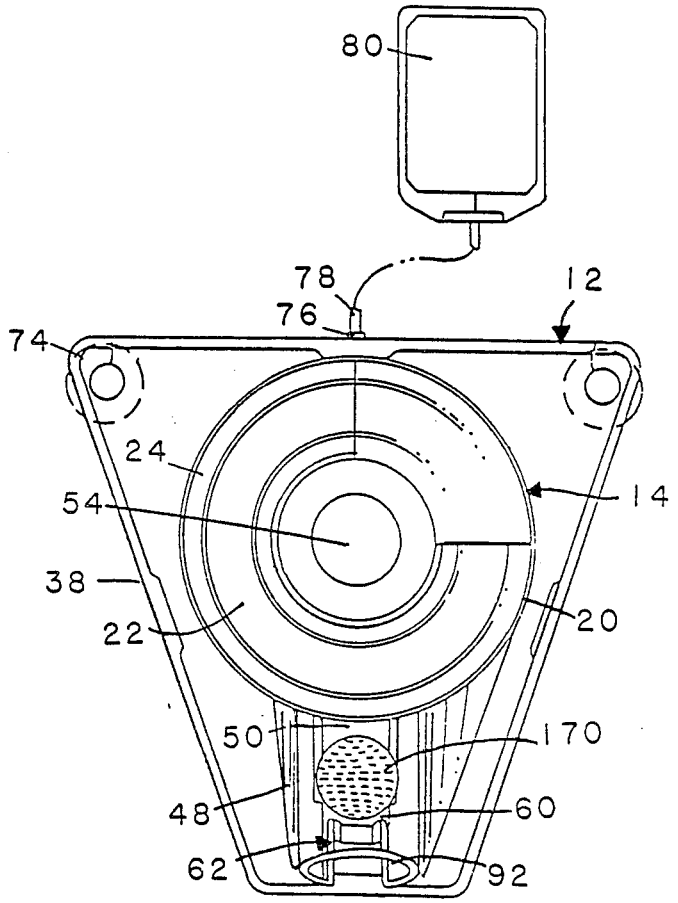
FIG. 1 is a plan view of the golf storage and dispensing apparatus of the invention.
Figure 3:
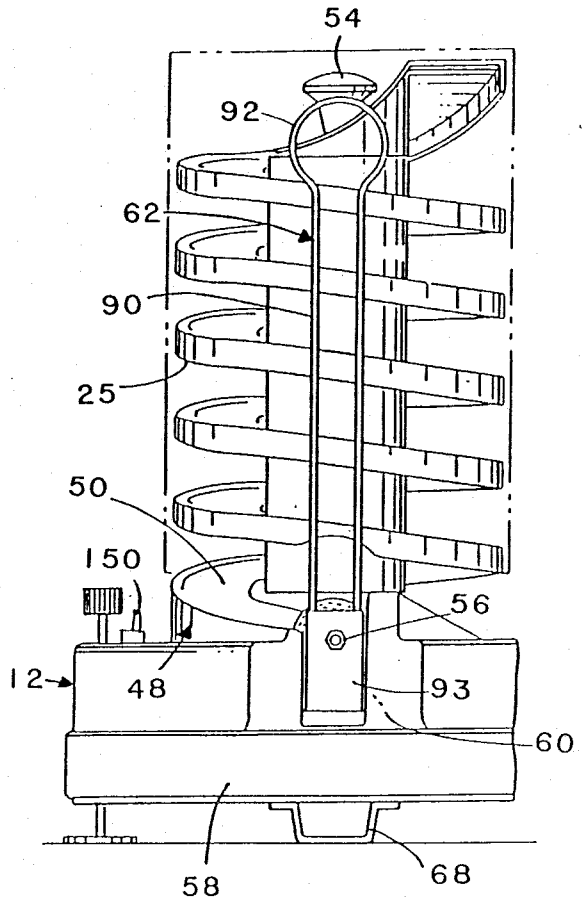
FIG. 3 is a front view of the apparatus shown in FIG. 1.

With reference to the drawings, and particularly FIGS. 1, 2, 3 and 4, there is shown a golf ball storage and dispensing apparatus 10 comprising a dispenser 12 and storage unit 14. The storage unit 14 is releasably attached to the dispenser 12 as will be described more fully hereunder.

The storage unit 14 comprises a hollow cylindrical core 16, a spiral hopper 18 about the core 16, and an optional outer cylindrical sleeve 20 surrounding the hopper 18. The sleeve 20 is preferably comprised of a transparent plastics material so that the number of golf balls contained within the hopper 18 can be determined at a glance.

The hopper 18 has a central canal 22 running along the length thereof. The hopper 18 also has a circumferential ledge 24 and a downwardly projecting flange 25 on the outer edge thereof, both of which are spaced to prevent the golf balls from escaping from the hopper 18, as well as from rubbing against (and moving) the sleeve 20 due to centrifugal forces.

The dispenser 12 (see FIG. 4) comprises a base member 26 and a cover 30 which fits over the base member to define a chamber 32. The base member 26 and cover 30 are both of frusto-conical shape in plan view, having a longer rear wall 34, a shorter front wall 36 and tapering sidewalls 38.

The upper surface 40 of the cover 30 has a substantially centrally located circular surface 42 having substantially the same diameter as the cylindrical core 16. An elongate shaft 44 extends upwardly from the center of the surface 42 and has a threaded portion 46 at its free end. The upper surface 40 of the cover 30 also has a track 48, the track 48 having a central canal 50 and a circumferential ledge 52.

In use, the lower end of the cylindrical core 16 of the storage unit 14 is received on the circular surface 42, so that the shaft 44 is inside the core 16. The threaded portion 46 of the shaft 44 projects beyond the upper end of the core 16. The storage unit 14 is rotated about its core 16 until the lower end of the spiral hopper 18 registers and is flush with the upper end of the track 48 on cover 30. In this way, the canal 22 on the hopper 18 and the canal 50 on the track 48 will form a substantially continuous surface and will not hinder the free movement of a golf ball rolling therealong. Additionally, the circumferential ledge 24 of the hopper 18 will register with circumferential ledge 52 of the track 48 so that the golf ball will remain within the central canals 22 and 50 respectively.

When the storage unit 14 is in its correct rotational position, it is fixed relative to the dispenser 12 by securing a cap 54 to the threaded portion 46 of the shaft 44. The cap 54 exerts a downward pressure on the core 16 to attach the storage unit 14 firmly to the surface 42 of the dispenser 12.

At the front end 58 of the cover 30 there is an aperture 60 having a width slightly less than the diameter of a golf ball. An arm 62 extends outwardly from the front end of the aperture 60 from within the chamber 32. Immediately below the aperture 60 and within the chamber 32 is a golf ball feed control 64. The feed control 64 (see FIG. 12) and arm 62 are connected to each other by bolt 56, and both form part of an actuator mechanism 66, to be described in greater detail below. The arm 62 is pivotable about the axis of the bolt 56 when a force is applied to the arm 62, such as by a swinging golf club. With this feature, the arm 62 will not snap and the feed control 64 will not be damaged, since the force is absorbed by rotation of the arm 62 about the bolt 56.

A centrally located fixed foot 68 (see FIGS. 2 and 3) is provided at the front end of the base member 26. Adjustable feet 70 are provided at each of the rear end corners of the base member 26. The adjustable feet 70 are connected to shafts 72, each shaft having a knurled knob 74 at its other end. By rotating the knob 74, a threaded portion of the shaft 72 moves in a threaded aperture (not shown) in the base member 26, and, in this way, the distance between the base member 26 and the surface on which the apparatus 10 is mounted can be varied according to the circumstances. Thus, the apparatus can be properly levelled.

A jack 76 (see FIG. 4) is located in the rear wall 34 of the cover 30. A plug 78 connected to a foot operated switch 80 connects to the jack 76. The foot operated switch 80 activates the actuator mechanism 66 as will be described more fully below.

A battery compartment 142 (see FIG. 5) is provided near the rear edge of the base member 26. An access door (not shown) is provided to the battery compartment on the underside of the base member 26. In this way, used batteries can easily be replaced without having to remove the cover 30 from the base member 26.

Figure 5:
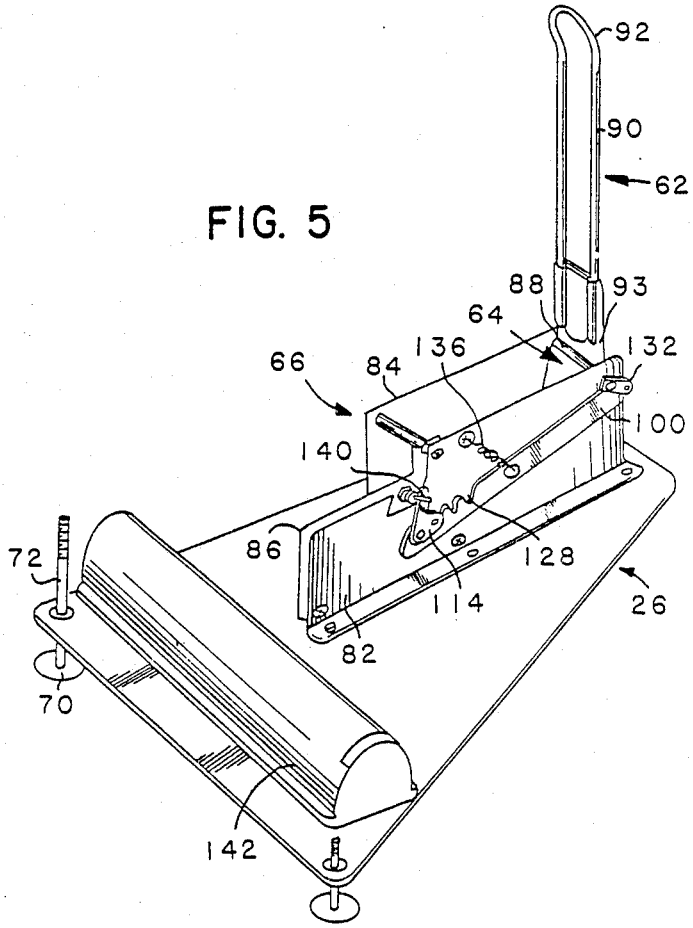
FIG. 5 is a perspective view of the base member of the dispenser with certain parts of the actuator mechanism omitted for clarity.
Figure 8:
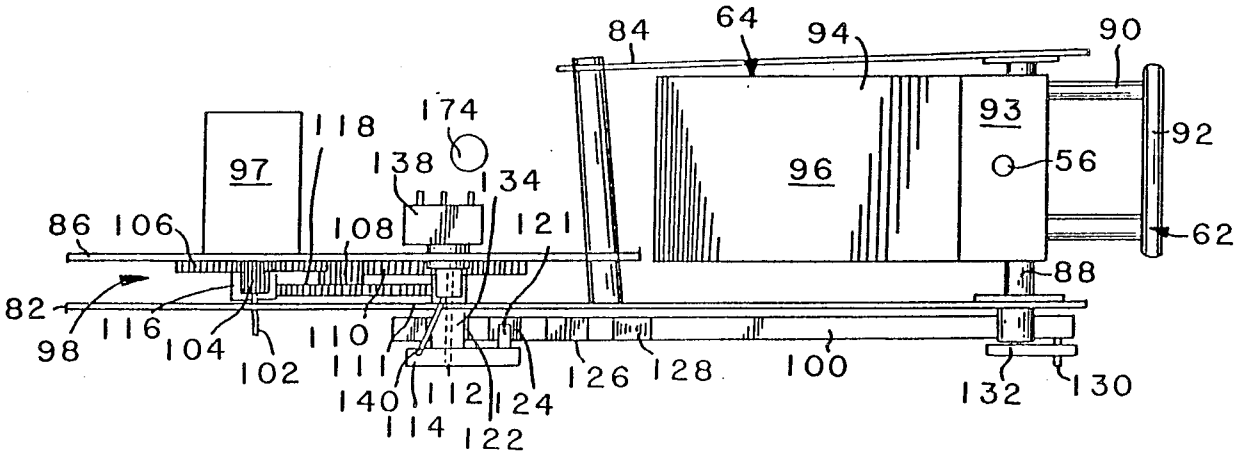
FIG. 8 is a plan view of the actuator mechanism.

Within the chamber 32, there is located an actuator mechanism 66 (see FIGS. 5 and 8). The actuator mechanism 66 comprises a pair of outer sidewall plates 82 and 84, and an intermediate wall plate 66. The plates 82, 84 and 86 are mounted to the base member 26, best shown in FIG. 5. The arm 62 and feed control 64 are mounted between plates 82 and 84 at the front end thereof. The feed control 64 is mounted to a support shaft 88 by a pair of rounded plate portions 89 (best illustrated in FIG. 12), while the one end of the arm 62 is clamped to the feed control 64 by bolt 56. The arm 62 comprises a pair of parallel shafts 90 and a rounded end 92 at the free end thereof. The distance between the parallel shafts 90 is less than the diameter of a golf ball, while the inner diameter of the rounded end 92 is greater than that of a golf ball.

Figure 12:
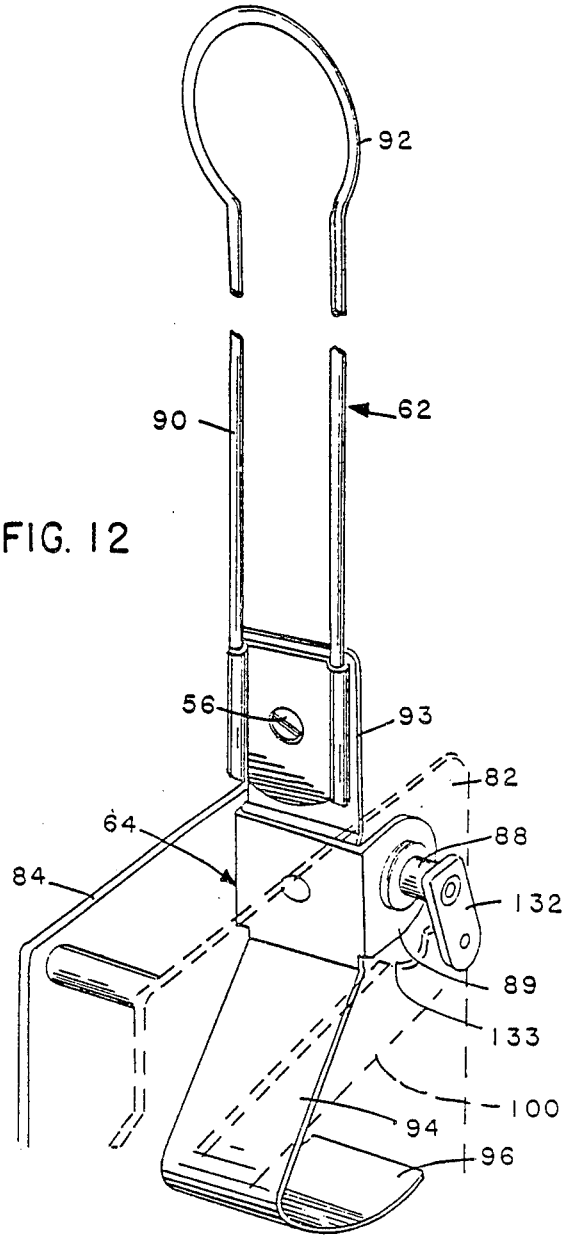
FIG. 12 is a perspective view of the arm mechanism.

The feed control 64 comprises a connector portion 93 for supporting the arm 62, a ramp portion 94 and a block portion 96 (see FIG. 12). The feed control 64 lies between the sidewall plates 82 and 84, with the distance between the sidewall plates 82 and 84 being slightly less than the diameter of a golf ball.

The arm 62 and feed control 64 are adapted to be rotated about the support shaft 88 through an angle of approximately 90°. The arm 62 is rotated from a substantially vertical position (as shown in FIG. 2 and FIGS. 9–11 of the drawings) to a substantially horizontal position. The arm 62 and feed control 64 are rotated with the shaft 88 by a motor 97, a gear train assembly indicated generally by the numeral 98, a rod 100 and a drive crank 132.

Figure 7:
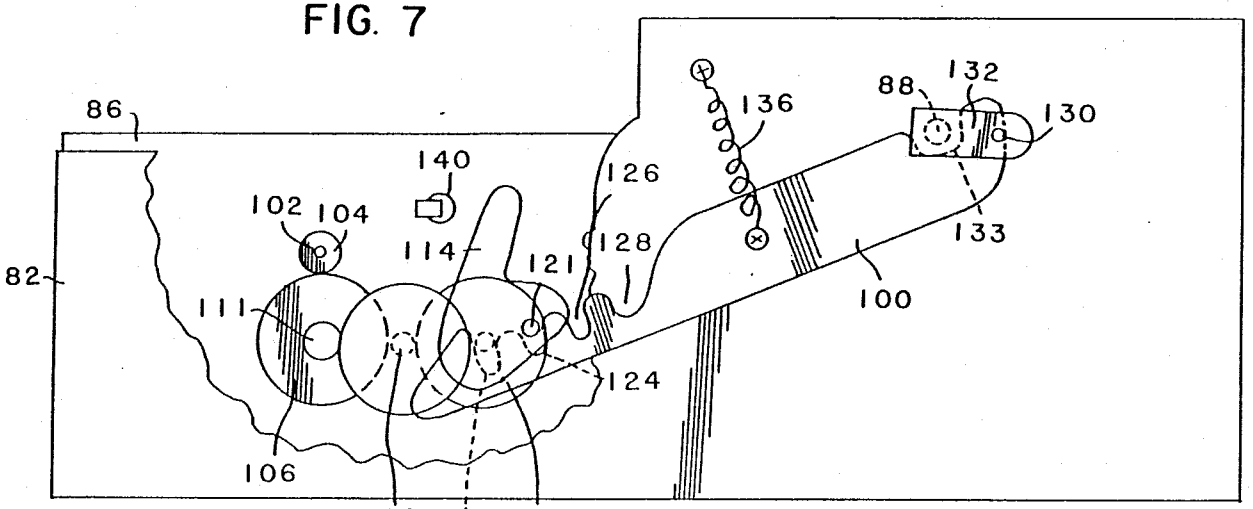
FIG. 7 is a partially cutaway side view of the actuator mechanism.

As clearly shown in FIG. 8, the motor 97 is fixed to the intermediate plate 86 and drives a shaft 102 and a toothed motor gear wheel 104 about the shaft 102. The gear wheel 104 transmits motion to a first intermediate gear wheel 106 which is co-axially mounted with a second intermediate gear wheel 116. The gear wheel 116 transmits motion to a third intermediate gear wheel 118 which is co-axially mounted with a fourth intermediate gear wheel 108. The gear wheel 108 in turn drives a rotor gear wheel 110. A rotor shaft 112 extends from the rotor gear wheel 110 through an aperture in the plate 82. A rotor 114 is mounted at the end of the rotor shaft 112, as best shown in FIGS. 7 and 8 of the drawings.

The rotor 114 is mounted at the end of the rotor shaft 112 so that it is spaced from the plate 82. The rotor 114 has a rotor arm 120 and a pin 121, the latter extending into the space between the rotor 114 and the plate 82.

The rod 100 extends between the rotor 114 and the support shaft 88. One end of the rod is received within the space between the plate 82 and rotor 114. There are four slots 122, 124, 126 and 128 in the upper edge of the rod. The four slots are equispaced from each other by a distance corresponding to that between the axis of the rotor shaft 112 and pin 121. The other end of the rod 100 is connected through a pivot shaft 130 to drive crank 132, the drive crank 132 in turn being connected to the support shaft 88. A recess 133 is provided in the upper edge of the rod 100 to accommodate the support shaft 88, as illustrated in FIG. 7.

As shown in FIG. 8, a sleeve 134 is fixed to the plate 82 and disposed about rotor shaft 112 in the space between the plate 82 and the rotor 114. The sleeve 134, having a diameter designed to fit in the slots 122 and 126, acts as an indexing pin for rod 100 and produces a smoother movement of rod 100, to be described hereunder. The slots 122 and 126 are shaped to facilitate smooth movement of the sleeve 134 therein. This sleeve, however, may be omitted from the shaft 112 without significantly affecting the operation of the device.

Figure 6:
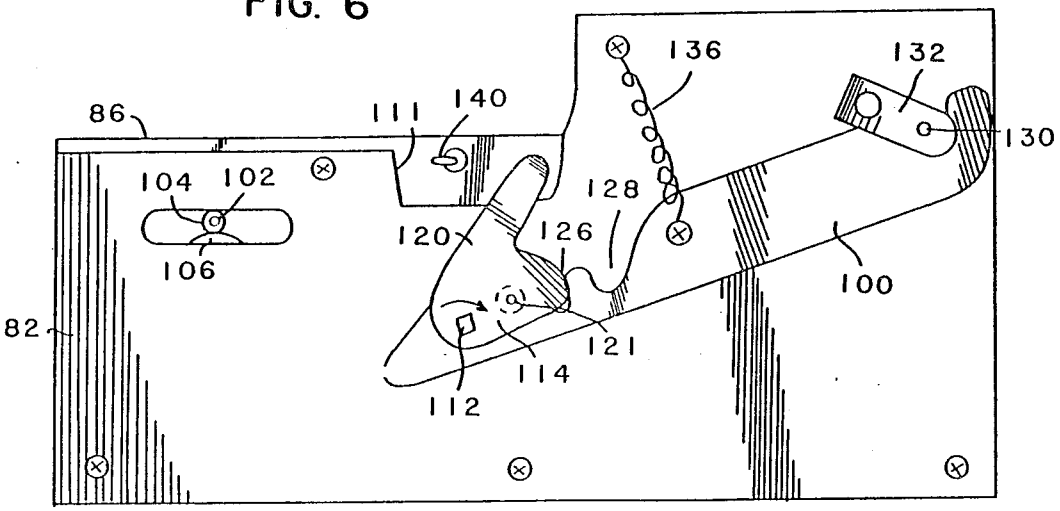
FIG. 6 is a side view of the actuator mechanism.

The rod 100 is held in its operational position and prevented from falling due to gravity by the action of a spring 136 (see FIGS. 6 and 7) fixed at its one end to the sidewall plate 82 and at its other end to a screw located approximately mid-way along the rod 100.

A switch 138 is mounted on the intermediate plate 86 above the rotor gear wheel 110. The switch 138 has a switch lever 140 extending through a cut out portion 111 of the plate 82 and beyond the plate 82. The switch lever 140 is adapted to be shifted by the rotor arm 120 of the rotor 114. Throwing this switch lever 140 controls, as will be described below, the direction in which the motor 96 turns The operation of the golf ball storage and dispensing apparatus will now be described.

Figure 2:
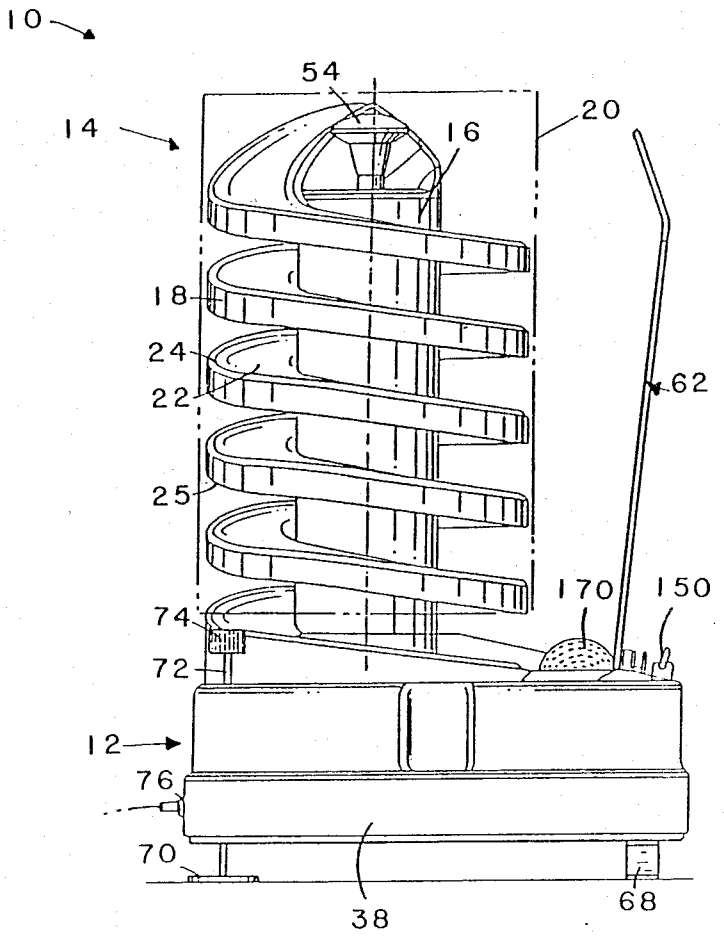
FIG. 2 is a side view of the apparatus shown in FIG. 1.
Figure 4:
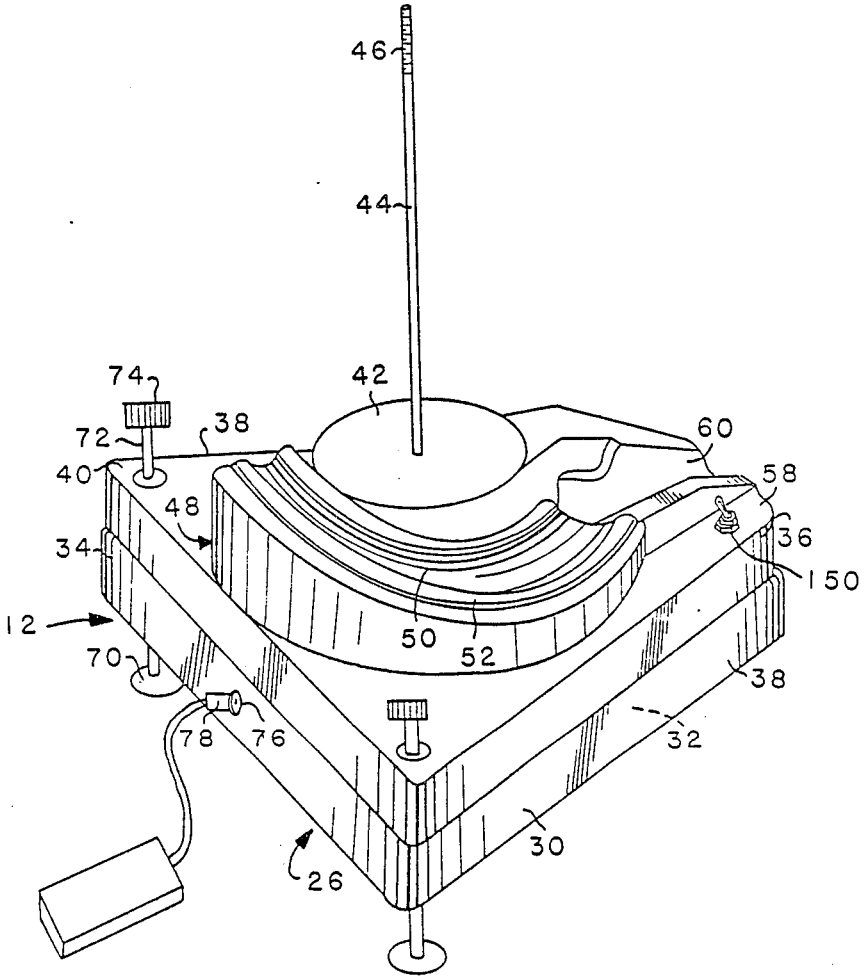
FIG. 4 is a perspective view of the dispenser of the invention.
Figure 9:
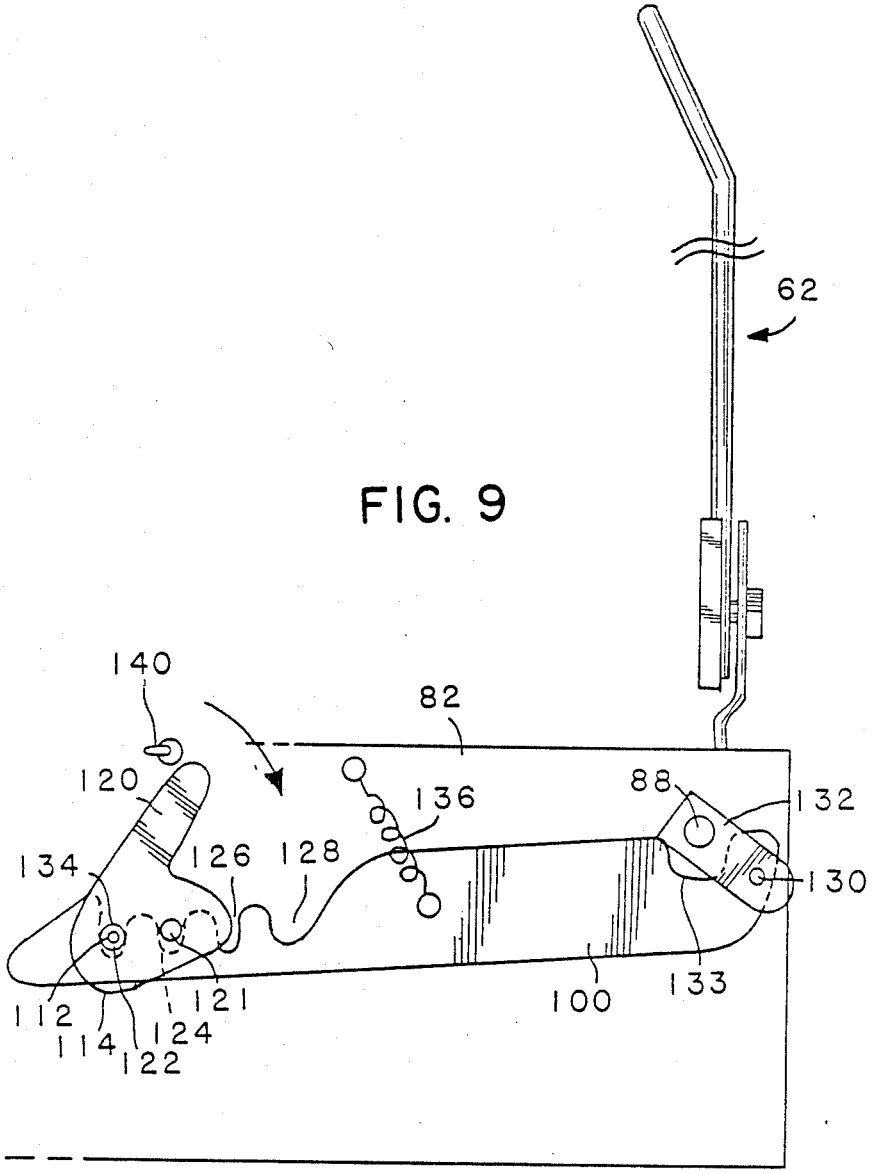
FIG. 9 is a side view of certain parts of the actuator mechanism before the rotor has commenced its movement.

The desired number of golf balls are fed into the spiral hopper 18 and these roll down the hopper 18 until the first ball 170 rolls onto the track 48 and over the aperture 60 at the front end 58 of the cover 30. The aperture 60 is dimensioned such that its width is less than the diameter of a golf ball so that the golf ball 170 will be held over the aperture 60 and not fall into the chamber 32. At this stage, the arm 62 is in the vertical position, as shown in FIGS. 2 and 9 of the drawings. The ramp portion 94 of the feed control 64 is at approximately 45° to the horizontal (see FIG. 12). This ramp portion 94 is located in the chamber 32 immediately below the aperture 60 over which the golf ball is located.

Figure 10:
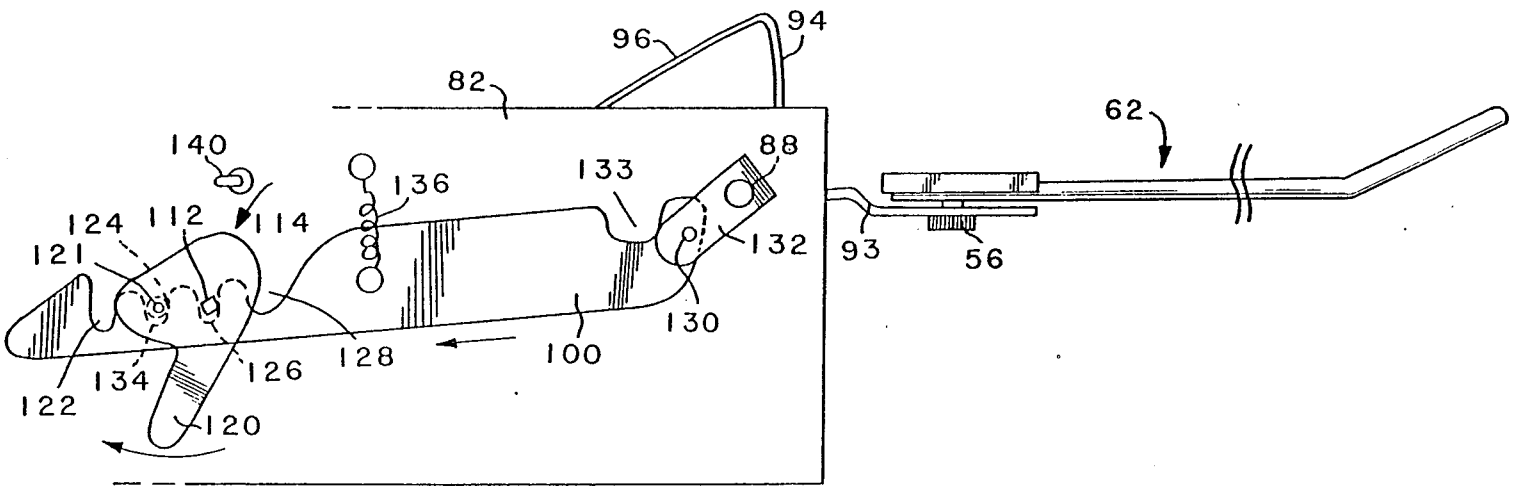
FIG. 10 is a side view as shown in FIG. 9 wherein the rotor has moved through approximately 180°.
Figure 11:
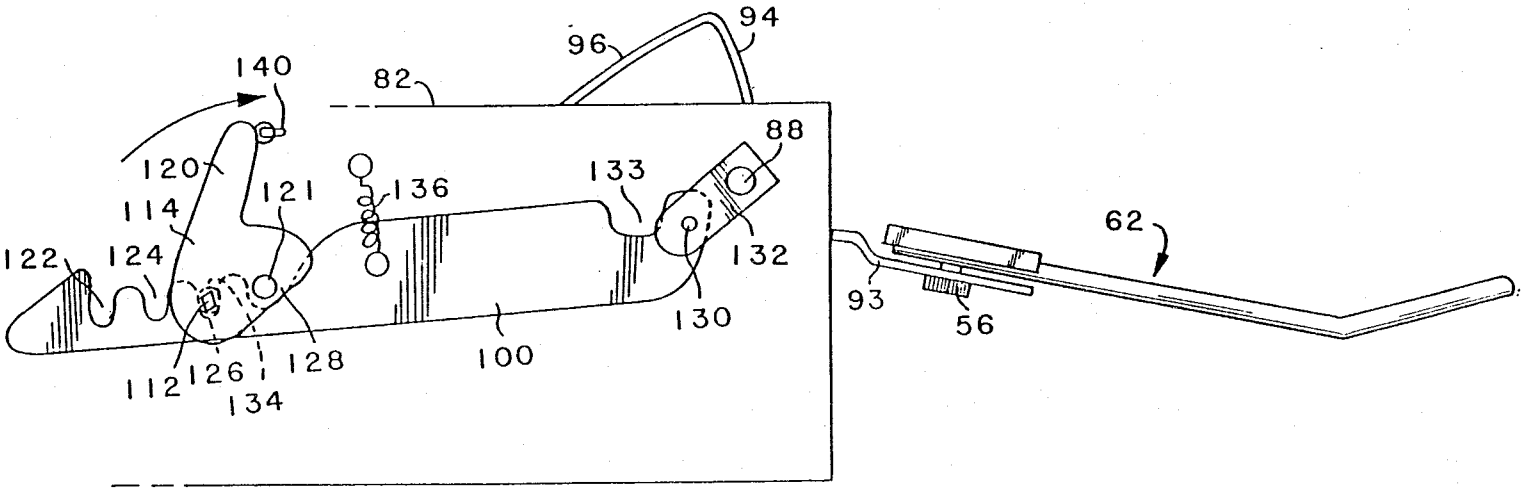
FIG. 11 is a side view as shown in FIG. 9 wherein the rotor has moved through approximately 360°.

The motor 97 is activated by depressing the foot operated switch 80. Due to the latching relay 174 (shown in FIG. 13 and described below), the switch 80 need only be depressed briefly to initiate the cycle to be described below. It is not necessary to keep the switch 80 depressed during the dispensing operation. The motor 97, once activated, rotates the gear wheel 104 and this motion is transmitted through the gear train 98 to the rotor 114. The rotor 114 commences a clockwise rotation, best illustrated in FIGS. 9, 10 and 11 of the drawings. The rotary motion of the rotor 114 is transmitted to cause the rod 100 to move along its axial length, as illustrated also in FIGS. 9, 10 and 11. At the commencement of the cycle (FIG. 9), the rotor shaft 112 and the sleeve 134 are located in a slot 122 while the pin 121 is located in slot 124. As the rotor 114 rotates, the pin 121 pushes the rod 100 down slightly and thereafter moves it to the left as shown in FIGS. 9, 10 and 11 of the drawings. As the rotor 114 continues its movement, the rod 100 is raised slightly due to the action of spring 136 and the shaft 112 is received within the slot 126. This occurs when the rotor 114 is approximately mid-way through its clockwise rotation (as shown in FIG. 10), after which the rod 100 is not moved along its longitudinal axis any further.

The rotor 114 thereafter completes its first clockwise rotation and the rotor arm 120 strikes the switch lever 140, moving this lever 140 to the right, as is shown if FIG. 11. This causes the switch 138 to reverse the direction of current in the motor 97, following which the rotor 114 rotates in the counter-clockwise direction. The slot 128 is located such that the pin 121 will be received therein as the rotor 114 reaches the end of its clockwise rotation, and the rod 100 will not be moved by the pin 121 at this stage.

The movement of the rod 100 to the left as shown in FIGS. 9, 10 and 11 of the drawings causes the crank drive 132 to move through an angular distance of approximately 90°. The crank drive 132 in turn rotates the support shaft 88 and hence the arm 62 and the feed control 64 through 90° as can be seen in FIGS. 9 and 10. As the feed control 64 rotates through 90°, it passes through the aperture 60 of the cover 30 and the golf ball 170 located over the aperture rolls down the rising ramp portion 94 of the feed control 64. The next golf ball will be prevented from rolling over the aperture 60 by the action of the block portion 96 of the feed control 64. The first golf ball 170 in the meanwhile rolls down the ramp 94 and onto the parallel shafts 90 of the arm 62. When the ball 170 reaches the end of the parallel shafts 90, it drops through the rounded end 92 and is placed on a tee, or on the ground, as desired by the golfer. It will be noted that the angle of the ramp portion 94 and the angle of the arm 62 when in the substantially horizontal position are such that the rolling speed of the ball is suitable for placing the ball in the desired position. As discussed fully below, the golf ball is deposited while the rotor 114 moves from its midway position of FIG. 10 to a full clockwise position shown in FIG. 11, and back again to the midway position.

As mentioned, after the switch lever 140 has been struck by the rotor arm 120, the direction of current in the motor is reversed and the rotor 114 thereafter turns in a counter-clockwise direction. In this way, the steps discussed above are reversed and the rod 100 is moved back to its initial position after the golf ball has been deposited. The arm 62 and feed control 64 are also rotated about the shaft 88 to their original positions. The block portion 96 is withdrawn into the chamber 32 and the next golf ball is thereafter permitted to roll over the aperture 60 so that it is ready to be dispensed by a similar operation as described above.

It will be noted that the longitudinal axial movement of the rod 100 occurs only during the first half of the clockwise turn and the second half of the counter-clockwise turn of the rotor 114. The effect is that after the arm 62 has been moved to the horizontal position, there will be a delay before it is returned to the vertical position. This delay corresponds to the movement of the rotor 114 through the second half of its clockwise movement and the first half of its return counter-clockwise movement. This delay provides sufficient time for the golf ball to roll down the ramp portion 94, across the parallel shafts 90, and drop through the rounded end 92. In this way, the arm 62 will not be returned to its vertical position before the ball has been dispensed.

When the rotor 114 has completed its counter-clockwise rotation, the rotor arm 120 strikes the switch lever 140, returning it to its original position, and this activates the switch 138 to switch off the motor 97. The actuator mechanism 66 is therefore once again at its commencement position to repeat the operation for dispensing a golf ball, as described above.

An interruptor switch 150 (see FIG. 4) is provided on the cover 30. When this switch 150 is in its operative position, it will cause the motor to be switched off after the switch lever 140 has been struck by the rotor arm 120 after the completion by the rotor 114 of its first clockwise rotation. The movement of the arm 62 will thus be frozen while it (the arm 62) is in the horizontal position. In this condition, the apparatus 10 can be accurately located so that the golfer will be able to set with some precision where each golf ball is to be placed. The apparatus will be located with the rounded end 92 of the arm 62 over the point where the golf ball is to be placed. The position can be tested by rolling golf balls down the arm 62 so that minor adjustments can be made, if necessary. Once this setting has been properly completed, as desired, the switch 150 is struck and motor 97 will once more be actuated so as to complete the cycle, as described above, and the arm 62 will be moved to the vertical position, ready to dispense the first golf ball.

The feed control 64 is adjustably mounted to the support shaft 88. While the frictional forces normally acting between the plate portion 89 and the support shaft 88 (see FIG. 12) are sufficient to prevent relative movement therebetween, the feed control 64 can be rotated about the shaft 88 by holding the shaft 88 steady and applying force to the feed control 64. In this way, the optimum angle of the arm 62, and hence the rolling speed of the golf ball, can be adjusted to the circumstances. The ability of the feed control 64 to move about the shaft 88 upon the application of force in excess of the frictional force therebetween also has the effect of protecting the motor and teeth of the gear wheels. Thus, if the free movement of the arm is in some way obstructed, there will be little extra stress on the motor, and the gear wheels will not be subjected to significant additional forces. If the arm is obstructed, the actuator mechanism will merely complete its cycle with the shaft 88 rotating but not turning the arm.

Figure 13:
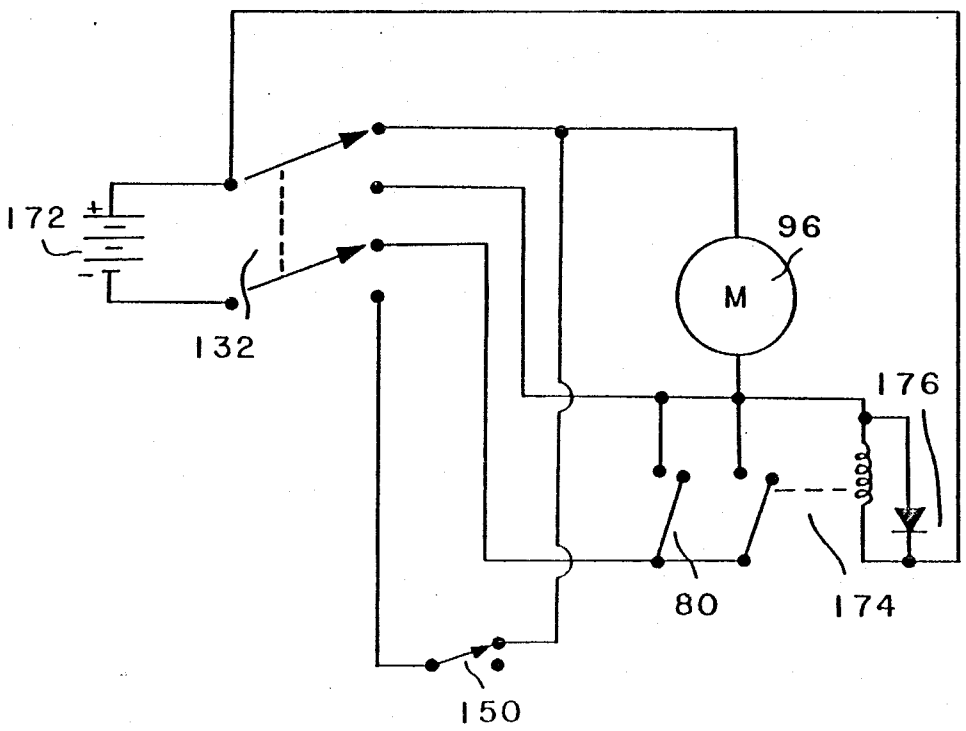
FIG. 13 is a schematic diagram of the electric circuit of the apparatus shown in FIG. 1.

Brief reference is now made to FIG. 13 of the drawings which shows a schematic diagram of a preferred electric circuit for operating the actuator mechanism 66. The operation of the circuit has been described above with reference to the operation of device as a whole, and will thus not be repeated at this point. It need only be added that the circuit incorporates a power source 172, a relay switch 174 to maintain the power supply to the motor 97 after the foot operated switch 80 has been released, and a diode 176. In this way, the switch 80 need only be briefly depressed to initiate the entire cycle, as mentioned above in the description of the cycle.

This invention is not limited to the precise constructional details as illustrated or described above. For example, any suitable device for storing the golf balls may be used. The features of the cover of the dispenser 12 may vary to achieve the same purpose, namely, to support the storage unit and convey golf balls to the actuator mechanism 66. Moreover, the shape of the dispenser is not limited to that described in the embodiment. Any suitable arm or mechanism may be used for delivering golf balls to the desired site. Additionally, the preferred embodiment may include other features, such as a timer to activate the activator mechanism to deliver a golf ball at preselected intervals.

I claim:

1. A golf ball storage and a dispensing apparatus comprising:

a dispenser unit;

a golf ball storage unit connected to the dispenser unit, the storage unit being adapted for storing a plurality of golf balls and for delivering successively to the dispenser unit a single golf ball;

an actuator mechanism mounted in the dispenser unit so that the balls delivered to the dispenser unit are directed to the actuator mechanism, the actuator mechanism comprising: a motor including a direction switch; an arm mechanism pivotable about a support shaft between a substantially vertical position and a substantially horizontal position; a gear train assembly having a series of interacting toothed gear wheels and a rotor with a rotor arm, the gear train assembly being intermediate the motor and the arm mechanism, the rotor arm striking the direction switch when the arm mechanism is in a substantially horizontal position thereby raising the arm mechanism to the substantially vertical position; a reciprocating rod between the gear train assembly and the arm mechanism, the rod being axially moved at its one end by the gear train assembly and having its other end connected to the support shaft of the arm mechanism whereby reciprocation of the reciprocating rod causes the arm mechanism to move between the vertical and horizontal positions; and delay means for retaining the arm mechanism in the horizontal position for a sufficiently long period to enable the golf ball to roll down the entire length of the arm mechanism and be deposited adjacent the dispenser unit.

2. Apparatus as claimed in claim 1 wherein the actuator mechanism further comprises a switch means for activating said actuator mechanism.

3. Apparatus as claimed in claim 2 wherein the dispenser unit includes a jack member connected to the motor, the jack member being adapted to receive a plug from the switch means for activating the actuating member.

4. Apparatus as claimed in claim 2 wherein the switch means for activating the actuator mechanism comprises a foot operated pressure switch.

5. Apparatus as claimed in claim 1 wherein the dispenser unit comprises a base member and a cover member over the base member, the base and cover members defining a chamber.

6. Apparatus as claimed in claim 5 wherein the cover has an aperture therein, the actuator mechanism is located in the chamber beneath the aperture, a portion of the arm mechanism projects through the aperture, and a track is provided on the upper surface of the cover for directing golf balls from the storage unit to the aperture.

7. Apparatus as claimed in claim 6 wherein the cover and base members have a shorter front wall, a longer rear wall opposite the front wall, and a pair of tapering side walls therebetween.

8. Apparatus as claimed in claim 1 wherein the storage unit comprises a central core, a spiral hopper surrounding the core, and an outer transparent cylindrical envelope about the spiral hopper.

9. Apparatus as claimed in claim 8 wherein the dispenser unit has a surface adapted to receive the lower end of the central core.

10. Apparatus as claimed in claim 9 further comprising an elongate shaft extending from the surface, the shaft being adapted to pass through the core of the storage unit, and whereby fastening means are fastened to a free end of the shaft to hold the core firmly on the surface.

11. Apparatus as claimed in claim 8 wherein the spiral hopper includes a central groove, an upwardly extending outer circumferential ledge and a downwardly depending rim, the ledge and the rim acting to prevent the golf ball from emerging from the hopper due to centrifugal forces.

12. Apparatus as claimed in claim 1 wherein the dispenser unit comprises at least one adjustable foot to vary the distance between the dispenser unit and the surface on which it is located.

13. Apparatus as claimed in claim 1 wherein the dispenser unit includes a battery compartment, to house the power source, the battery compartment having an access door on the outside of the dispenser unit.

14. Apparatus as claimed in claim 1 wherein the arm mechanism comprises a feed control mounted on said support shaft, and an elongated arm connected to said feed control by means of a bolt member, said bolt member permits said elongate arm to rotate about the longitudinal axis of the bolt relative to the feed control on the application of force to said arm.

15. Apparatus as claimed in claim 1 wherein the arm mechanism comprises a pair of parallel shafts, the distance between which is slightly less than the diameter of a golf ball, and a rounded end, the diameter of which is greater than that of a golf ball, the arrangement being that a golf ball will roll between the pair of parallel shafts and drop through the space defined by the rounded end.

16. Apparatus as claimed in claim 1 wherein the gear train assembly comprises a first gear wheel about the motor shaft, a series of four intermediate gear wheels, and an end gear wheel having a shaft which is in contact with the rod.

17. Apparatus as claimed in claim 1 wherein the rotor is mounted to a shaft of an end gear wheel in the gear train assembly.

18. Apparatus as claimed in claim 1 wherein: the rotor has a body portion mounted on the rotor shaft, a rotor arm extending from the body portion in a direction normal to the axis of the shaft on which the rotor is mounted, a pin extending from the body portion substantially parallel to the rotor shaft; the rod has a series of four open-ended slots therein, with the rotor shaft being located in the first slot and the pin being located in the second slot when the arm mechanism is in the vertical position, whereby when the rotor shaft with rotor is rotated, the pin rotates about the rotor shaft in the second slot causing the rod to substantially reciprocate in an axial direction until the rotor has completed one half turn, the rotor shaft being received in the third slot after a half turn, and upon completion of a full turn, the rotor arm strikes said direction switch thereby reversing the current in the motor to cause the rotor to turn in the opposite direction thereby moving the rod to its original position, the rotor arm striking the direction switch at the completion of its return rotation to switch off the motor.

19. Apparatus as claimed in claim 1 further comprising a selectively operable interruptor switch for imterrupting the movement of the arm mechanism when it is in the horizontal position, the arm mechanism completing its cycle back to the vertical position when the interruptor switch has been de-activated.

20. A golf ball storage and dispensing apparatus comprising:

a dispenser unit;

a golf ball storage unit connected to the dispensing unit, the storage unit being adapted for storing a plurality of golf balls and for delivering successively to the dispenser unit a single golf ball;

an actuator mechanism mounted in the dispenser unit so that the balls delivered to the dispenser unit are directed to the actuator mechanism, the actuator mechanism comprising: a motor including a power source and a direction switch; an arm mechanism pivotable about a support shaft between a substantially vertical position and a substantially horizontal position; a gear train assembly having a series of interacting toothed gear wheels, the gear train assembly being intermediate the motor and the arm mechanism; a reciprocating rod having a series of four open-ended slots therein, the rod being located between the gear train assembly and the arm mechanism and being moved at its one end by the gear train assembly and having its other end connected to the support shaft of the arm mechanism; delay means for retaining the arm mechanism in its horizontal position for a sufficiently long period to enable the golf ball to roll down the length thereof and be deposited adjacent the dispenser unit; and a rotor mounted to a rotor shaft of an end gear wheel of the gear train assembly, the rotor having a body portion mounted on the rotor shaft, a rotor arm extending from the body portion in a direction normal to the axis of the rotor shaft, a pin extending from the body portion substantially parallel to the rotor shaft, the rotor shaft being located in the first slot and the pin being located in the second slot when the arm mechanism is in the vertical position, the pin rotating about the rotor shaft in the second slot causing the rod to substantially reciprocate in an axial direction until the rotor has completed part of its turn, the rotor shaft being received in the third slot after part of its turn, and upon completion of a turn the rotor arm strikes the direction switch to reverse the motor to turn the motor in the opposite direction moving the rod to its original position, the rotor arm striking the direction switch at the completion of its return rotation to switch off the motor.

21. Apparatus as claimed in claim 20 further comprises a selectively operable interruptor switch for interrupting the running of the motor after the rotor arm has struck the direction switch thereby freezing the arm mechanism while it is in the horizontal position, the motor being re-activated to complete the cycle for moving the arm mechanism back to the vertical position only after the interruptor switch has been de-activated.

22. Apparatus as claimed in claim 20 wherein the rod is connected to a crank drive which rotates the support shaft causing the arm to move from a vertical to a substantially horizontal and back to a vertical position when the rod is reciprocated.

23. Apparatus as claimed in claim 20 further comprising a sleeve mounted about the rotor shaft.

24. Apparatus as claimed in claim 23 wherein the sleeve is fixed relative to the rotor shaft, and the rotor shaft rotates within the sleeve.

25. Apparatus as claimed in claim 23 wherein the first and third slots have a shape complementary to the sleeve thereby insuring smooth movement of the rod upon rotation of the rotor.

26. An actuator mechanism for a ball storage and dispenser apparatus having a dispenser unit and a storage unit, the actuator mechanism comprising:

a motor having a power source and a direction switch;

an arm mechanism pivotal about a support shaft between a substantially vertical position and a substantially horizontal position;

a gear train assembly having a series of interacting toothed gear wheels and a rotor with a rotor arm, the gear train assembly being intermediate the motor and the arm mechanism, the rotor arm striking the direction switch when the arm mechanism is in a substantially horizontal position thereby raising the arm mechanism to the substantially vertical position;

a reciprocating rod between the gear train assembly and the arm mechanism, the rod being axially moved at its one end by the gear train assembly and having its other end connected to the support shaft of the arm mechanism, whereby reciprocation of the reciprocating rod causes the arm mechanism to move between the vertical and horizontal positions; and delay means for retaining the arm mechanism in the horizontal position for a sufficiently long period to enable the golf ball to roll down the entire length of the arm mechanism and be deposited adjacent the dispenser unit.

27. A mechanism as claimed in claim 26 further comprising a switch means for activating the actuator mechanism.

28. A mechanism as claimed in claim 27 wherein the switch comprises a foot operated pressure switch.

29. A mechanism as claimed in claim 26 wherein the rotor is mounted to the shaft of the last gear wheel in the series of the gear train assembly.

30. A mechanism as claimed in claim 29 wherein: the rotor has a body portion mounted on the rotor shaft, a rotor arm extending from the body portion in a direction normal to the axis of the shaft on which the rotor is mounted, a pin extending from the body portion and being substantially parallel to the rotor shaft; the rod has a series of four open-ended slots therein, with the rotor shaft being located in the first slot and the pin being located in the second slot when the arm mechanism is in the vertical position, whereby when the rotor shaft with rotor is rotated, the pin rotates about the rotor shaft in the second slot causing the rod to substantially reciprocate in an axial direction until the rotor has completed one half turn, the rotor shaft being received in the third slot after a half turn, and upon completion of a full turn, the rotor arm strikes a direction switch thereby reversing the current in the motor to cause the rotor to turn in the opposite direction thereby moving the rod to its original position, the rotor arm striking the direction switch at the completion of its return rotation to switch off the motor.

31. A mechanism as claimed in claim 30 further comprising a sleeve mounted about the shaft.

32. A mechanism as claimed in claim 31 wherein the first and third slots have a shape complementary to the sleeve thereby insuring smooth movement of the rod upon rotation of the rotor.

* * * * *